US006050540A

United States Patent [19]

O'Reilly

[11] Patent Number: 6,050,540

[45] Date of Patent: Apr. 18, 2000

[54] MOLD ASSEMBLY FOR MAKING CUSTOMIZED LIPSTICK COLORS

[76] Inventor: Betsy O'Reilly, 7260 SW. 119th St., Miami, Fla. 33156

[21] Appl. No.: 09/064,558

[22] Filed: Apr. 22, 1998

[51] Int. Cl.[7] ..... B29C 33/00

[52] U.S. Cl. ..... 249/95; 249/102; 249/105; 249/160; 249/164; 425/183; 425/DIG. 32

[58] Field of Search ..... 249/105, 108, 249/117, 154, 155, 156, 160, 163, 164, 102, 83, 90, 95; 425/183, 195, DIG. 32, 112, 117, 116, 127; 206/223, 581, 229, 575; 264/255

[56] References Cited

U.S. PATENT DOCUMENTS

| | | | |
|---|---|---|---|
| 1,286,651 | 12/1918 | Kendall | 425/DIG. 32 |
| 1,799,524 | 4/1931 | Morgan | 249/105 |
| 2,573,141 | 10/1951 | Heinrich | 425/DIG. 32 |
| 2,652,592 | 9/1953 | Williams | 264/255 |
| 2,855,632 | 10/1958 | Croce et al. | 425/DIG. 32 |
| 2,879,548 | 3/1959 | Croce et al. | 425/DIG. 32 |
| 3,494,309 | 2/1970 | Grisel | 425/DIG. 32 |
| 3,585,265 | 6/1971 | Motsavage et al. | 264/255 |
| 3,788,590 | 1/1974 | Hasselbach | 249/164 |
| 3,881,682 | 5/1975 | Kin | 249/164 |
| 4,813,801 | 3/1989 | Cardia | 425/DIG. 32 |
| 5,160,689 | 11/1992 | Kamen | 425/DIG. 32 |
| 5,780,018 | 7/1998 | Collins et al. | 425/DIG. 32 |

FOREIGN PATENT DOCUMENTS

| | | | |
|---|---|---|---|
| 578179 | 1/1994 | European Pat. Off. | 425/DIG. 32 |
| 469707 | 7/1937 | United Kingdom | 425/DIG. 32 |

*Primary Examiner*—Duane S. Smith
*Attorney, Agent, or Firm*—Malloy & Malloy, P.A.

[57] ABSTRACT

A multi-part mold assembly, which may be incorporated in a kit assembly along with other structural components, to form a lipstick product which is either formed from a plurality of unused remnants of previously used lipstick products or a "customized" lipstick made up of a newly blended color or alternatively, a lipstick having at least two separately colored longitudinal halves. In one embodiment, the mold assembly is specifically structured to form a whole or complete lipstick product whether from the left-over portions or remnants of several lipsticks or from a one or more colors to arrive at a "customized" lip color, for example by mixing a main or base shade with another color in order to darken or lighten the main shade. In another embodiment, the mold assembly is specifically structured to form a first lipstick segment in a first operative position and to form a second lipstick segment in a second operative position, which second lipstick segment bonds with the first lipstick segment to define a complete, newly formed lipstick product having a conventional, elongated cylindrical configuration with at least two separately colored segments, preferably in the form of two separately colored longitudinal halves. The present invention also includes a kit assembly and a method for forming one of the lipstick products, described above, by utilizing the multi-part mold assembly of the present invention.

17 Claims, 2 Drawing Sheets

MOLD ASSEMBLY FOR MAKING CUSTOMIZED LIPSTICK COLORS

BACKGROUND OF THE INVENTION

1. Field of the Invention

The present invention relates to a mold assembly and a method for making lipstick. In particular, the mold assembly of the present invention is structured and disposed to form either a lipstick having at least two separately colored segments, such as two separate longitudinal halves, or alternatively, a traditional lipstick either made of a single color, such as from the left-over portions or remnants of a plurality of lipsticks, or made of a newly blended color. The present invention is also directed to a method as well as a kit for making one or all of the above lipsticks.

2. Description of the Related Art

Adding color to the lips to enhance a woman's beauty and attractiveness has been a custom for many years, and it is thought, even for centuries. During contemporary times, color for the lips is readily available as "lipstick" meaning that a lip color, which has the consistency of soft wax, is formed into a small tubular shape, the distal end of which has an angled tip with a flat face so as to aid in the smooth application of the color to the lips. In addition, the lipstick is typically held within a dispenser in the form of a small cylindrical tube which often includes a movable platform disposed within the tube's interior. Typically, the other proximal end or base of the lipstick is firmly implanted within the movable platform such that upon a rotational movement being applied to the tube, the movable platform will move upwardly or downwardly along the length of the tube so as to permit the exposure of either more or less of the lipstick, as desired. Often, the afore-described dispenser for the lipstick includes a cap to protect the distal end region of the lipstick which is typically not fully retractable within the tube of the dispenser. During contemporary times, the dispenser and protective cap are coordinated to provide a very attractive package, with colors and metallic markings being frequently used. There are many cosmetic manufacturers which offer the afore-described lipstick and lipstick packaging, as can be easily verified by walking through any department store. Oftentimes, the cosmetic counters in such department stores include showy and elaborate displays of the many and various lip colors in which lipsticks are available.

Despite the myriad of lip colors available, however, it is quite common for women to become attached to only one or two lip colors for repeated daily wear. In most cases, such women become very loyal to that chosen or favorite lipstick color, such that when a tube of the preferred lipstick color is running low, they will proceed to buy another tube of lipstick having that same lipstick color. Oftentimes, such women will continue to buy and replace a particular shade of lipstick for a period of years. Consequently, such women may eventually accumulate several tubes of lipstick with a small amount of the lip color left over in each tube. That is because as the stick of lip color is repeatedly used, the stick becomes smaller and smaller, until eventually, each time the stick is placed on the lips to apply color, the rim of the movable platform within the lipstick tube or dispenser, which holds the proximal end or base of the lipstick, also contacts the lips and begins to scrape against the lips during application, causing discomfort. Once that occurs, the only choice is for the woman to use a small brush to dip into lip color which remains in the dispenser and to then use the brush to apply the color to the lips. However, because that process is time consuming and requires the use of a mirror, it is quite common for women to simply accumulate several tubes of lipstick with a small amount of the lip color left over in each. Usually, these women are reluctant to throw away and waste the left over lipstick and hang onto it in the belief that they will eventually use it, although invariably, they do not. It should be noted that the movable platform found within most commonly available lipstick dispensers are about one-half inch in length and also about one-half inch in diameter. This translates to more than just a minimal amount of lipstick being left over within the movable platform of the lipstick dispenser and explains why some are reluctant to throw out tubes of lipstick with some lip color left in them. Accordingly, there is a need in the art for an apparatus and method which will permit the recycling of such left over portions or remnants of a lipstick color.

Also despite the myriad of lip colors available, it is fairly common for some women to arrive at their own customized color. It seems that oftentimes, women arrive at such customized colors either by accident or by experimentation. For instance, a woman might apply one shade of lipstick and then, choose a second, lighter or darker shade or even a frosted shade to apply as a top coat to the lips. Sometimes, the resulting "customized" look will become the favorite lip shade to which the woman becomes loyal. But here again, the process of applying two separate lip colors is time consuming, often requires the use of a mirror, and more importantly, requires that the two separate lipstick tubes (if not more) holding the chosen colors of the combination be located and/or carried on the person for re-application of the lip colors. Accordingly, there is a need in the art for an apparatus and method which will readily and easily permit the formation of a lipstick having at least two separately colored segments, and preferably two separately colored longitudinal halves, so as to result in a single lipstick tube which offers the chosen "customized" look or shade. Any such apparatus or method should preferably allow for alternative ways to customize a lipstick color, such as for example, by lightening or darkening or otherwise altering the color of a selected main or base shade.

SUMMARY OF THE INVENTION

The present invention is directed to solve the needs which remain in the art and in particular, is directed to a method for making lipstick which includes a mold assembly structured and disposed to form either a traditional lipstick from a single color or a blend of colors, or a lipstick having at least two separately colored segments, most preferably comprising two separately colored longitudinal halves.

The mold assembly of the present invention comprises either a two part or a multi-part mold assembly which is designed to form a lipstick product having a substantially elongated, cylindrical configuration. In one embodiment, the mold assembly comprises a first and a second mold part, with a first cavity formed in the first mold part, the first cavity structured and disposed to form a first segment of the lipstick product being formed therein, and preferably, a first longitudinal half thereof. Further, the first and a second mold part each includes a primary mating face, and are selectively positionable into and out of at least a first forming position defined by confronting engagement of the primary mating faces thereon. The primary mating face of the first mold part preferably includes the first cavity in contiguous relation to the primary mating face thereof, while the primary mating face of the second mold part may comprise a substantially planar configuration disposable in covering relation to the first cavity in the first mold part, when the first and second mold parts are assembled in the first forming position. The first and second mold parts are further cooperatively structured to form the first segment of the lipstick product, meaning less than the entire elongated, cylindrical configuration thereof, when in the first forming position. In another embodiment, the second mold part of the mold assembly also includes a secondary mating face, and a second cavity formed in the second mold part in contiguous relation to this secondary mating face, with the second cavity being structured and disposed to form a second segment of the lipstick product, preferably a second longitudinal half thereof. The second cavity is positionable in aligned relation to the first cavity to define a second forming position, with the first and second mold cavities cooperatively dimensioned and configured to form a complete lipstick product defined by the first and second segments in the second forming position. In an alternative embodiment, the mold assembly includes in addition a third mold part having a primary mating face and a second cavity formed therein in contiguous relation to the primary mating face thereof, wherein this second cavity is structured and disposed to form the second segment of the lipstick product. Similarly, the second cavity in the third mold part is positionable in aligned relation to the first cavity of the first mold part to define a second forming position, the first and second cavities being cooperatively dimensioned and configured to form a complete lipstick product defined by the first and second segments.

In addition to a mold assembly, the present invention also comprises a kit assembly for forming a lipstick product. The kit assembly preferably comprises the mold assembly and a removing tool structured and disposed to remove lipstick from dispensers or other containers of previously used lipstick products, as well as a heating utensil structured and disposed to collect and contain such lipstick portions and to permit heating thereof. Preferably, the heating utensil is further structured and disposed to facilitate the transfer of the heated lipstick portions to the mold assembly while in a liquified state, and the kit assembly may further include at least one container or lipstick dispenser which is dimensioned and configured to receive the lipstick product being formed in the mold assembly.

In addition to a mold assembly and a kit assembly, the present invention also comprises a method for forming a lipstick product comprising the steps of collecting a quantity of lipstick, whether all of a single color or some from various colors to be blended together, heating the quantity of lipstick until at least partially liquified, and transferring the quantity of partially liquified lipstick into the mold assembly. In that regard, the method may include the step of assembling the first and second mold parts to form a first segment of the lipstick product to be formed, followed by a cooling step, and the reassembling of the mold parts to form in the mold assembly a second segment of the lipstick product, followed by another cooling step, and the joining of the first and second segments to define a complete lipstick product having a predetermined dimension and configuration. Alternatively, the method may include the step of assembling the first and second mold parts or the first and third mold parts to form a complete lipstick product having a predetermined dimension and configuration, followed by a cooling step, and removal of the lipstick product from the assembly for insertion into a lipstick dispenser.

A primary object of the present invention is to provide an apparatus and method which allows the left over portions or remnants of a lipstick color to be recycled so as to result in a new stick of that lip color, which further, can be readily utilized in combination with traditional lipstick packaging for ease of application and carrying purposes.

Another primary object of the present invention is to provide an apparatus and method which will also readily and easily permit the formation of a lipstick having at least two separately colored segments, and preferably, two separately colored longitudinal halves, so as to result in a single lipstick that offers a "customized" look or shade.

An advantage of the present invention is that it permits a woman to utilize the remaining portions of lipsticks, typically that portion at or near the base of a lip stick which is implanted within the movable platform found within most traditional tubes or dispensers for packaging lipsticks, which might otherwise be wasted.

Another advantage of the present invention is that it permits a woman or other user to fully utilize the remaining portions of lipsticks, without requiring the use of a lipstick brush or even a mirror.

Yet another advantage of the present invention is that it readily permits a woman or other user to create a customized lip color, which further, can be easily carried in a single lipstick tube or packaging.

A feature of the mold assembly of the present invention is that it readily permits the formation of a lipstick which is either of a single color of lipstick remnants or a blend of colors from various lipstick remnants, or a lipstick which has at least two separately colored segments, and most preferably, two separately colored longitudinal halves.

These and other objects, features and advantages of the present invention will be more readily apparent to those skilled in the art from a review of the description of the preferred embodiments and the drawings, as will now be described.

BRIEF DESCRIPTION OF THE DRAWINGS

For a fuller understanding of the nature of the present invention, reference should be had to the following detailed description taken in connection with the accompanying drawings in which:

FIG. 3-A is a top view of the mold assembly illustrated in FIG. 3.

Like reference numerals refer to like parts throughout the several views of the drawings.

DETAILED DESCRIPTION OF THE PREFERRED EMBODIMENT

Figure 1:
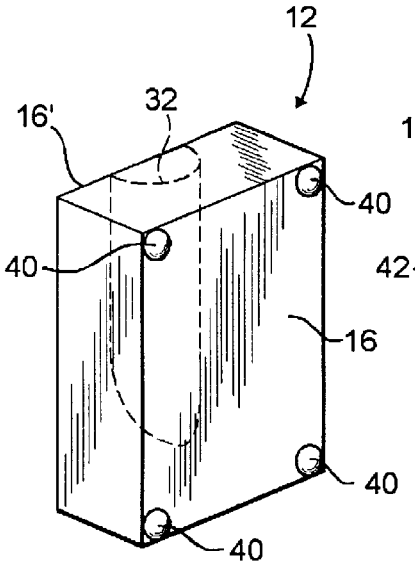
FIG. 1 is a perspective view of two mold parts which at least partially define a mold assembly of the present invention.

Throughout the various Figures, the present invention is primarily directed to a mold assembly for forming a lipstick product, and is generally indicated by reference numeral 2. The mold assembly 2 can be used either to form a lipstick product from the left-over, unused and/or remnant portions of one or more previously used lipstick products or to form a customized lipstick product having at least two separately colored segments and/or a lipstick product having a newly blended or customized color. The mold assembly 2 of the present invention may be incorporated as part of a kit assembly, also part of the present invention, which includes a plurality of other components used to produce one or more of the aforesaid lipstick products. The present invention is further directed towards a method of forming one or more of the aforesaid lipstick products.

Figure 12:
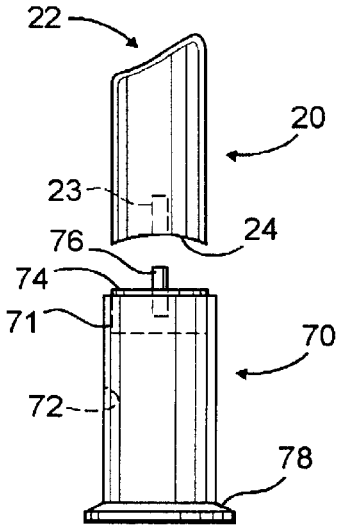
FIG. 12 is a partial exploded view of the dispenser shown in FIG. 11 and further illustrating the dispenser and lipstick mounted therein in an operative extended position.

With initial reference to FIG. 1, the present invention is seen to comprise a multi-part mold assembly which includes at least a first mold part, generally indicated by reference numeral 10, and a second mold part, generally indicated by reference numeral 12. Each of the mold parts of the assembly can be formed of a metallic material, preferably aluminum, although stainless steel or another metal or even a suitable plastic based material might also be utilized. Both of the first and second mold parts, 10 and 12, include a primary mating face, as at 14 and 16, respectively. In the embodiment of FIG. 1, at least one of the mold parts 10 includes a first mold cavity 18 which is specifically dimensioned and configured to form a segment or partial portion, preferably but not necessarily limited to a first longitudinal half of a resulting lipstick product, which is perhaps best illustrated in FIGS. 3-A, 4, 12 and 13, and indicated generally by reference numeral 25. More specifically, and as depicted in FIG. 12, the resulting lipstick product 20 will preferably be formed by the cavity 18 of the first mold part 10 to have an elongated, configuration that includes a first end or base, 24, and an oppositely disposed second or top end, 22, which is specifically configured to conform generally to the lips of a user, and thereby, facilitate the application of the lipstick. Still referring to FIG. 1, the first mold cavity 18 is formed in first mold part 10 so as to be substantially contiguous with the primary mating face 14 thereof. The innermost end of the cavity 18, as at 18', is closed and is shaped so as to properly configure the end 22 of the lipstick product 20, as shown in FIG. 12 and as has been described. In a preferred embodiment, the opposite end of cavity 18 is open, as at 18", and is disposed in direct communicating relation to one end or side 17 of the first mold part 10 in which it is formed.

Figure 3:
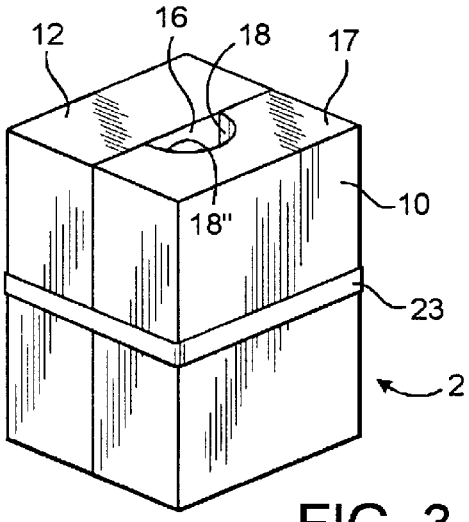
FIG. 3 illustrates the two mold parts depicted in FIG. 1 disposed in mating engagement with one another and comprising an operative position for forming a first segment of a lipstick product.

In a preferred embodiment, the second mold part 12 has a mating face 16 which is formed into a substantially flat or planar configuration. As shown in FIG. 3, this second mold part 12 when disposed in mating engagement with the first mold part 10 comprises an operative, first forming position for producing a first portion or segment 25 of a lipstick product 20, preferably a longitudinal half of the resulting lipstick product, as perhaps best illustrated in FIG. 13, and which will be described in greater detail subsequently. As illustrated, the planar mating face, 16 of the second mold part 12 is disposed in overlying, covering relation to the cavity 18 formed in the first mold part 10.

As illustrated in FIGS. 1 and 3, the mold assembly of the present invention additionally comprises in a preferred embodiment, an alignment structure for causing the first and second mold parts 10, 12 to be properly aligned with one another in the operative, first forming position depicted in FIG. 3. By way of example, the alignment structure may be defined by a plurality of protrusions, 40, formed on the primary mating face 16 of the second mold part 12, as shown in FIG. 1, which are sized, dimensioned and configured to be received by correspondingly positioned recesses 42 formed in the primary mating face 14 of the first mold part 10. With this type of an alignment structure, the first and second mold parts 10 can be assembled into the first forming position shown in FIG. 3, snugly fit and in close adjacent engagement with each other, by virtue of the removable, mating engagement of the protrusions 40 within the recesses 42, and further, with the planar mating face 16 properly aligned with the mating face 14 and the cavity 18. When in such position, the mold assembly will more preferably also include a connecting structure, such as but not limited to, an elastic band, a belt or tightly wound string, etc., and depicted by reference numeral 23 in FIGS. 3 and 4, disposed in surrounding and/or inter-connecting relation, such that the two mold parts 10 and 12 are secured in the aforementioned first forming position. The assembled mold parts 10 and 12 of the present invention are then ready to form a first segment 25 of the lipstick product 20.

Figure 2:
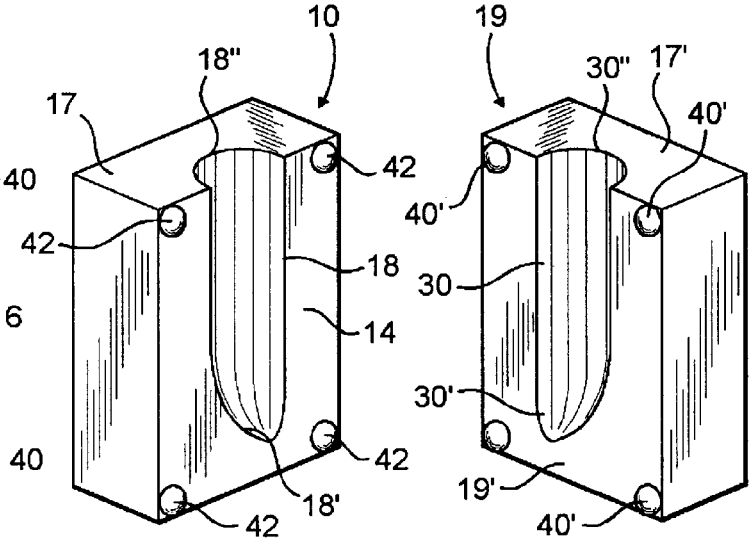
FIG. 2 is a perspective view of another embodiment of the present invention comprising a third mold part which defines the mold assembly of the present invention.
Figure 4:
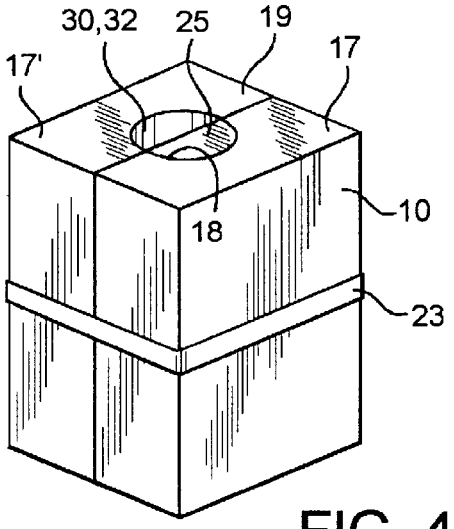
FIG. 4 is a perspective view of two mold parts, one of which is an alternative embodiment, disposed in mating engagement with one another to comprise a second operative position for forming a lipstick product, and further wherein one of the mold parts is partially filed with a material used to form the lipstick product.
Figure 3A:
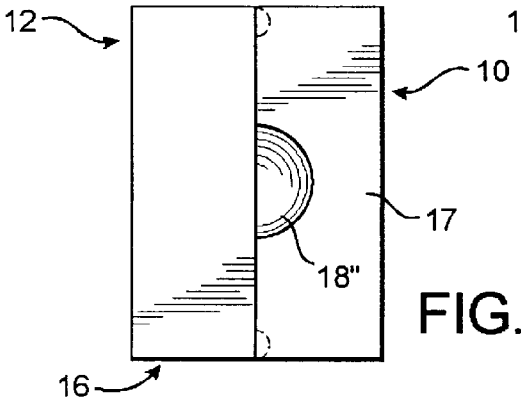
Figure 5:
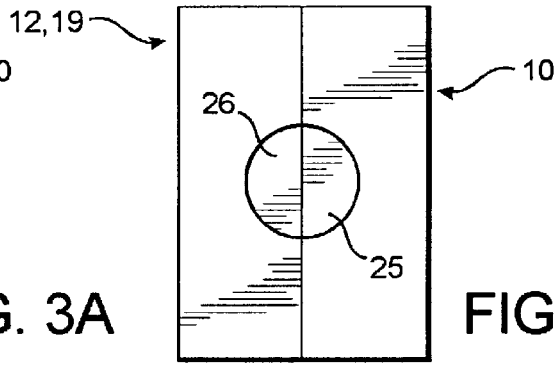
FIG. 5 is a top view of the mold assembly illustrated in FIG. 4 with both mold parts being at least partially filled with a material used to form the lipstick product.
Figure 13:
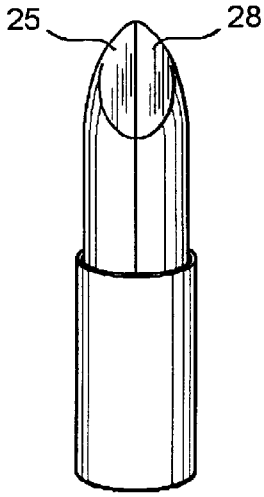
FIG. 13 is a front view of a lipstick product formed by the mold assembly of the present invention and having two separately colored longitudinal halves.

Referring now to FIG. 2, the mold assembly 2 of the present invention will preferably also comprise a third mold part, 19. In this embodiment, the third mold part 19 comprises an entirely separate third member having a second mold cavity 30, as illustrated in FIG. 2. It is contemplated, however, that the third mold part might alternatively comprise the oppositely disposed mating face, 16', of the second mold part 12, seen in FIG. 1, with a second mold cavity formed therein, designated by reference numeral 32. In any event, the second mold cavity of the third mold part 19 is specifically dimensioned and configured to form a second segment or partial portion 26 of a resulting lipstick product, and preferably, a second longitudinal half 28, as illustrated in FIG. 13. Similar to the first mold cavity 18, described above, the second mold cavity 30 is structured and disposed to form a resulting lipstick product 20 which has an elongated configuration that includes a first end or base, 24, and an oppositely disposed second or top end, 22. Further, the second mold cavity 30 is formed within third mold part 19 so as to be sized, dimensioned and configured to substantially align with first segment or partial portion 25 of the lipstick product 20 formed by the cavity 18 of the first mold part 10 and to result in a substantially cylindrical lipstick product 20. As seen in FIG. 2, the second mold cavity 30 is also preferably formed in third mold part 19 so as to be substantially contiguous with the primary mating face 19' thereof, and again, the innermost end of the cavity, as at 30', is closed and is shaped so as to properly configure the end 22 of the lipstick product 20, as has been described. Also in the preferred embodiment, the opposite end of cavity 30 is open, as at 30", and is disposed in direct communicating relation to one end or side 17' of the third mold part 19 in which it is formed. Accordingly, and as shown in FIGS. 4 and 5, this third mold part 19, can also be disposed in mating engagement with the first mold part 10 to comprise an operative, second forming position for producing a lipstick product 20, wherein the mating face, 19' of the third mold part 19 is disposed in overlying, covering relation to the cavity 18 formed in the first mold part 10. Here again, the third mold part 19 will preferably also include corresponding alignment structure, such as a plurality of protrusions 40' properly aligned with the recesses 42 on first mold part 10 so as to allow these mold parts to be properly aligned with one another, and further, a connecting structure, such as 23, might also be utilized to secure these mold parts 10, 19 together in the aforementioned second, operative lipstick-forming position. The lipstick product 20 which results from the mold assembly depicted in FIGS. 4 and 5 can be a complete or whole lipstick product 20. Alternatively, the lipstick product 20 which results from the mold assembly depicted in FIGS. 4 and 5 can be a second portion or segment, and ideally, a separately colored longitudinally half 28 of a lipstick product 20, which conforms in size and shape to and which is secured to the first portion or segment 25 formed in the mold assembly depicted in FIG. 3, which resulting lipstick product is perhaps best illustrated in FIG. 13. Both types of the resulting lipstick product will now be described in greater detail with regard to the method of the present invention.

As described above, the lipstick product 20 which results from the mold assembly depicted in FIGS. 4 and 5 can be a complete or whole lipstick product 20, which in one preferred embodiment, is formed from a collection of left-over, unused and/or remnant portions of one or more previously used lipstick products. Alternatively, the resulting whole lipstick product 20 might be formed from the blending of a favorite lipstick color with one or more other colors of lipstick so as to lighten or darken the favorite lipstick color and/or to arrive at a newly blended, customized lipstick color. Regardless, the method for utilizing the mold assembly 2 of the present invention depicted in FIGS. 4 and 5, as well as components of the kit assembly of the present invention, each of which will be explained in greater detail hereinafter, to form a resulting lipstick product, will now be described.

Figure 8:
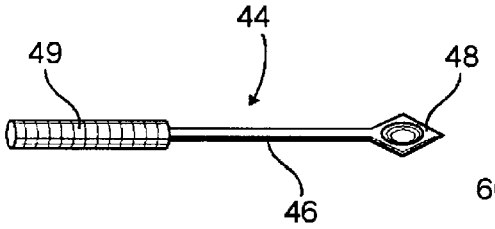
FIG. 8 is a front view of another component of the kit assembly according to the present invention for forming a lipstick product, namely, a removing instrument.
Figure 9:
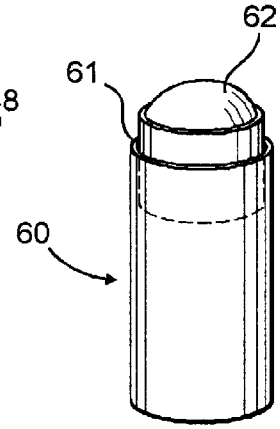
FIG. 9 is a perspective view of a typical lipstick dispenser in the form of a small cylindrical tube and further depicting the left-over or unused portion of a lipstick, the main body of which has already been eroded by repeated use.
Figure 10:
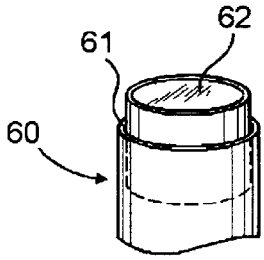
FIG. 10 is a front view in partial cutaway of the dispense and left-over lipstick illustrated in FIG. 9.

As an initial step, when it is desired to produce a lipstick product that is made from collected remnants or unused portions of previously used lipstick products, the remnants must first be removed from their original dispensers or containers, such as generally represented in FIGS. 9 and 10. More specifically, the left over lipstick portion or remnant 62 is usually found within the movable platform 61 provided in most common lipstick dispensers 60, and as has been described, because each movable platform is generally about one-half inch in height or length and about one-half inch in diameter, it will generally take about three or four of the left-over lipstick portions in these movable platforms to form a new lipstick product with the mold assembly of the present invention. To accomplish the removal of the remnants or left over lipstick portions, a removing tool, 44, depicted in FIG. 8, will preferably be utilized. Of course, it may be desired to simply lighten or darken a favorite lipstick shade and/or to form a newly blended color and in that case, instead of collecting many remnants or left-over lipstick portions, a quantity of the main or base lipstick color would be collected along with a quantity of one or more other lipsticks to either lighten or darken the main shade and/or to produce a new custom color, as the case may be. Upon removal of the various remnants from their containers, or upon the collection of the quantities of lipstick colors to be blended, they are preferably collected in a heating utensil, 50, depicted in FIG. 7, and are heated. It should be pointed out, however, that it would be within the scope of the present invention to utilize the mold assembly 2 as the heating utensil if the material with which it is made is suitable for that purpose. The heating of the collected lipstick remnants or quantities continues until they are at least partially, if not completely, liquified, whereupon the heated and liquified lipstick is preferably poured from the heating utensil 50 and into the mold assembly illustrated in FIGS. 4 and 5. More specifically, a sufficient quantity of heated lipstick is preferably poured within the cavities 18 and 30 of the first and third mold parts 10 and 19, which are assembled in the aforementioned second, operative lipstick forming position, until they are substantially filled to the brims of the open ends 18" and 30". The liquified lipstick within the cavities 18 and 30 of mold parts 10 and 19, is then allowed to cool using a variety of methods, as will be explained in greater detail hereinafter. Subsequent to cooling, one of the mold parts 10 or 19 is removed and separated from the other mold part, whereupon, the resulting lipstick product can be removed and inserted within a dispenser.

Returning now to the mold assembly depicted in FIGS. 3 and 3-A, it is intended to form a lipstick product 20 which preferably has two separately colored longitudinal halves, as best shown in FIG. 13. Accordingly, the method for utilizing the mold assembly 2 of the present invention as depicted in FIGS. 3 and 3-A, to form that type of resulting lipstick product, will now be described. As an initial step, a sufficient quantity of lipstick color must be collected, usually but not necessarily by removing same from its original dispensers or containers, such as generally represented in FIGS. 9 and 10, to create one of the longitudinal halves which make up the resulting lipstick product. To accomplish this, the removing tool, 44, depicted in FIG. 8 can be utilized. Upon the collection of the quantity of lipstick color, it is preferably gathered in the heating utensil, 50, depicted in FIG. 7, and heated, although here as well, it would be within the scope of the present invention to utilize the mold assembly 2 as the heating utensil. The heating of the quantity of lipstick color continues until it is at least partially, if not completely, liquified, whereupon it may be poured from the heating utensil 50 and into the mold assembly illustrated in FIGS. 3 and 3-A. Specifically, a sufficient quantity of the heated lipstick color is preferably poured within the cavity 18 of the first mold part 10, which is bounded by the flat planar face 16 of the second mold part 12, when these two mold parts 10, 12 are assembled in the first, operative lipstick forming position, and poured to substantially fill the cavity 18 to the brim of open end 18". The liquified lipstick within the cavity 18 of mold part 10 is then allowed to cool as will be explained in greater detail hereinafter. Subsequent to cooling, the second mold part 12 is removed and separated from the first mold part 10. A second lipstick segment or longitudinal half, designated by reference numeral 28 in FIG. 13, can now be formed utilizing the third mold part 19.

Specifically, subsequent to the curing or solidification of the first segment 25, the third mold part 19 is positioned adjacent the first mold part 10, with the first solidified segment or longitudinal half of the lipstick 25 remaining therein, see FIG. 4. Further, the third mold part 19 is positioned so that the second mold cavity thereof, 30 or 32, is in aligned relation with the first mold cavity 18, and overlying the first cavity 18 with the cured and solidified first lipstick segment 25 maintained therein. It should be pointed out that in an embodiment wherein the second mold part 12 is structured to include an oppositely disposed mating face 16' having a second mold cavity 32 formed therein, there is no need for a separate third mold part 19. Conversely, if second mold part 12 is provided without the cavity 32, the third mold part 19 or a structural equivalent thereof having mold cavity 30 formed therein will be used.

After joining of the first mold part 10 with either the second or third mold parts 12 or 19, respectively, an additional amount of heated lipstick, 26, namely that color selected to make up the second longitudinal half of the resulting lipstick product, is poured into the open top of the cavity 30 or 32 until it is substantially filled, see FIG. 5 . The two mold parts 10 and 12, or, 10 and 19 are maintained in their mating, interconnected relation to one another to define the second forming position of FIG. 5. Such second forming position is maintained until the lipstick material in the second molding cavity 30 or 32 is also allowed to cure or solidify. During this curing step, as the remnant material is being cooled within cavity 30 or 32, it serves to at least partially liquify the contacted surfaces of the previously formed first segment 25. As a result, a fixed, "integral" bonding will take place thereby serving to permanently interconnect the first segment 25 with a second segment 26 defined by the solidification of the previously heated lipstick remnants in the second molding cavity 30 or 32. When the cooling period for the second segment 26 is complete, segment 26 is solidified and the connecting structure as at 23 may be removed from both of the mating mold parts. Subsequently, one of the mold parts 10 or 19 is removed and separated from the other mold part, whereupon, the resulting lipstick product can be removed and inserted within a dispenser. If necessary, the lipstick product 20 resulting from either mold assembly can be subjected to a final heat-glazing step so as to remove any scuffs, seams or other visible flaws in the lipstick and render a smooth finish.

In order to facilitate the formation of the resulting lipstick product 20 from either mold assembly depicted in FIGS. 3–5, especially in a domestic environment, the present invention further contemplates a kit assembly. The kit assembly of the present invention comprises a mold assembly, as described above, as well as various structural components utilized to aid in the formation of the lipstick product 20. While not limited to the following described purpose, the kit assembly facilitates the formation of a lipstick product 20 from a plurality of left-over, unused portions or remnants of previously used and collected lipstick products, such as of the type represented in FIGS. 9 and 10. More specifically, and as has been discussed previously, it is common practice for women to accumulate a plurality, if not several tubes of lipstick with some lip color left over in each tube. That is because as a lipstick is repeatedly used, the stick becomes smaller and smaller, until eventually, the stick is eroded to a point, seen in FIG. 9, where continued application of the lipstick 62 results in the rim of the movable platform 62 within the dispenser 60 also contacting the lips, which can scrape the lips and cause discomfort and/or an injury. Thus, there is often a quantity of left-over or unused lipstick 62 which remains in the container or tube dispenser 60 for the lipstick, as illustrated in FIGS. 9 and 10, which many women are reluctant to discard in hopes that it will one day be used up. However, due to the overall shape and configuration of the container 60, and the method of exposing the lipstick product through an open end thereof, as by movable platform 61, it is generally impossible given the discomfort and/or risk for injury, to apply the left-over portions directly to the lips of a user. While it is possible to utilize these left-over lipstick portions with a lip brush, that requires that one be available and further, the use of a mirror to ensure proper application on the lips, all of which is time consuming.

Consequently, many women accumulate a plurality of tubes of lipstick with some lip color left over in each tube rather than throw them out, and at least partly in recognition of this situation, the kit assembly of the present invention comprises a removing tool, 44, illustrated in FIG. 8. The removing tool 44 preferably comprises an elongated stem 46 having one end specifically configured, as at 48, into a scoop, which might also be fashioned to include a somewhat pointed or sharpened tip, and in general, is configured to facilitate the removal of the left-over, unused and/or remnant portion of lipstick 62 from the container 60. To facilitate the manipulation of the removing tool 44, a handle, as at 49, may be secured to one end thereof. The overall dimension and configuration of the removing tool 44 is such as to facilitate removal of the left-over or unused lipstick portions 62 from a container 60, although the removing tool 44 might also be utilized to separate a quantity of lipstick from a stick of lip color, i.e., that which is not necessarily a left-over or remnant portion, to make a lipstick product 20 in accordance with the present invention.

Figure 7:
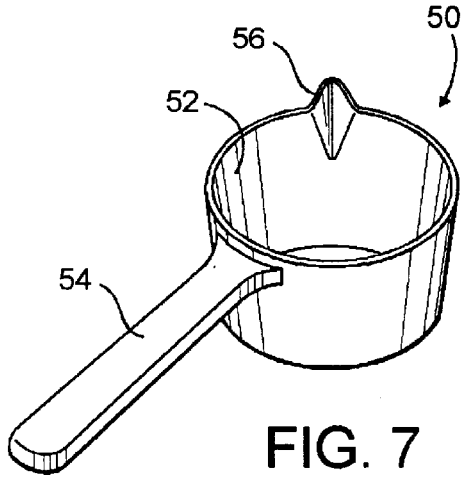
FIG. 7 is a perspective view of another component of the kit assembly according to the present invention for forming a lipstick product, namely, a heating utensil.

In any event, the remnants or other unused portions 62 of lipstick will need to be collected for heating purposes, and as such, the kit assembly of the present invention also preferably comprises a heating utensil 50. With reference to FIG. 7, heating utensil 50 includes an interior portion 52 which is dimensioned and configured to collect the remnants or other unused lipstick portions 62 which are retrieved. Further, the interior portion 52 is structured and dimensioned so as to allow heating and the resulting liquification of the remnants or unused lipstick portions 62, during the heating process. A handle, as at 54, may be provided for the manipulation and positioning of the heating utensil 50. In addition, the heating utensil may include a spout or similar pouring structure, 56, so as to facilitate removal of the heated, liquified remnants or other lipstick from the interior portion 52 of the utensil 50 into the open end of the cavities 18, 30 and/or 32, as described above with reference to FIGS. 1–5. The heating utensil 50 is preferably formed of a metallic material to permit its being heated directly on a stove, over a flame or burner, in an oven, etc., such as might be readily found in a home or other setting. Alternatively, the heating utensil 50 may be formed of a heat resistant, non-metallic material which would allow the heating utensil 50 to be placed within a microwave oven or like conventional source of microwave energy for the heating of the remnants collected within the interior portion 52 thereof.

Figure 6:
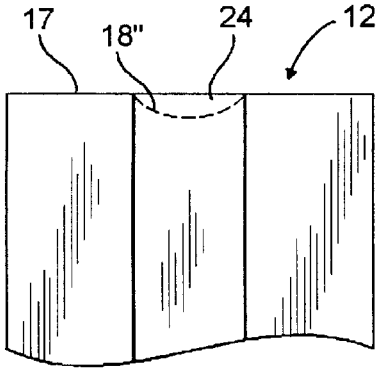
FIG. 6 is a front view in partial cutaway of the partially formed lipstick product in one of the mold parts of the embodiments of FIGS. 1 or 2.
Figure 11:
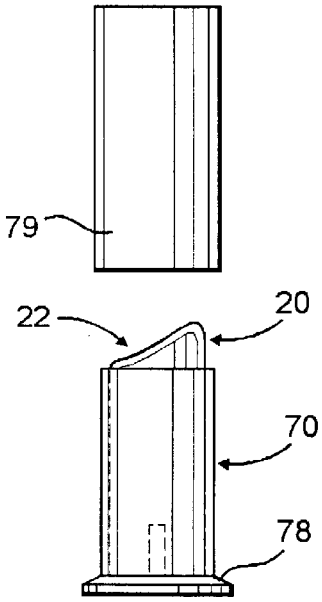
FIG. 11 is an illustration of a dispenser for containing a lipstick product according to the present invention, in a retracted position and with a lipstick product mounted therein.

With reference to FIGS. 11 and 12, the kit assembly of the present invention would preferably also include at least one, but ideally a plurality of lipstick containers, 70. The container 70 may be formed from an inexpensive, yet durable, high-strength plastic material to have a substantially tubular configuration with an elongated hollow interior. The hollow interior, as at 72, is specifically dimensioned and configured to receive the first end 24 or base region of the lipstick product 20, seen in FIG. 12, which has an elongated cylindrical configuration of a generally corresponding dimension so as to be received within the hollow interior 72. In this regard, the container or tube 70 may include a movable platform 71, similar to the type found in commercially available dispensers, which upon rotation of the dispenser, permit the exposure of either more or less of the lipstick along its length, as desired. With that type of dispenser or container, it is contemplated that the lipstick product 20 resulting from the method of the present invention, can be manipulated out of the mold assembly either manually or with a separate tool, and the first end 24 or adjacent base region then mounted on the movable platform within hollow interior 72. However, in a preferred embodiment, the container or lipstick dispenser 70 will include an attachment portion 74 which facilitates mounting of the lipstick product 20 onto a movable platform 72. Attachment portion 74 may be integral with movable platform 72 or secured thereto, but will in general be movable interiorly along the length of the container or dispenser 70. Also, because the base or first end 24 of the resulting lipstick product 20 will have a generally or somewhat concave configuration following cooling, as shown in FIG. 6, the attachment portion 74 will preferably be structured and disposed to facilitate a rather secure mounting of the lipstick product 20 to container 70. Thus, in the more preferred embodiment, attachment portion 74 comprises an outwardly extending finger, 76, positioned in an exposed location so as to penetrate, as at 23 in FIG. 12, the base or end 24 of the lipstick product 20, thereby serving to secure the formed cylindrically shaped lipstick product 20 to the attachment portion 74 as it moves longitudinally along the interior 72 of the container 70. Once positioned and interconnected, the lipstick product 20 is retracted along almost its entire length through the manipulation of a movable, rotational attachment portion. Manipulation of base 78 serves to position the attachment portion 74 in a manner which allows retraction of the lipstick product 20 within the interior of the container 70, as best shown in FIG. 11. The outermost end as at 22, which is specifically shaped to conform to the lips of the wearer, may protrude outwardly from the open end of the tubular container 70 as also shown in FIG. 11. A cover or like structure as at 79 may be removably disposed in covering relation to the open end and the lipstick product end 22 protruding therefrom.

As has been described, the present invention is also directed to a method of forming the lipstick product 20 utilizing the mold assembly as shown in the preferred embodiments in FIGS. 1–5. As generally set forth above, subsequent to collecting the lipstick remnants or other lipstick portions and the heating of same to the extent that they are at least partially liquified, the mold parts 10 and 12, or 10 and 19, are joined together such that their primary mating faces 14 and 16, or 14 and 16', or 14 and 19' are disposed in confronting engagement with one another, which position is maintained through the attachment of a connecting structure 23 thereto. Once so positioned, at least a portion of the previously heated lipstick material is poured into the open end of the cavity 18 or cavities 18 and 30. The material within the cavity is then allowed to cool. Cooling can be accomplished either through subjecting the entire mold assembly, meaning both of the attached mold parts and lipstick material held therein, to an atmosphere of reduced temperature such as in a conventional refrigerator or freezer, which step may take between generally about five and fifteen minutes. Alternatively, cooling can be accomplished by allowing the mold assembly to stand substantially at room temperature until the material within the cavity is solidified or cured, which step may take longer but generally not more than about twenty minutes to one half hour. Once cured, the formation of either a complete lipstick product 20 or a first segment or longitudinal half 25 has occurred. With respect to the latter, subsequently, either the second or third mold part 12 or 19, depending on the embodiment utilized, is joined such that a second mold cavity 30 or 32 respectively formed in the second or third mold parts 12 or 13, is joined in aligned relation with the cavity 18 containing the previously cured or solidified first segment 25 of the lipstick product 20. Once disposed in the second forming position as represented in FIG. 5, a second amount of previously heated lipstick material is poured from the interior portion 52 of the heating utensil 50 through the open end of either the cavity 30 or 32 of FIG. 5. Again, it is pointed out that the second preheated amount of lipstick material is poured into the second cavity 30 or 32 while the first segment 25 previously formed and cured is maintained within the first cavity 13. A second cooling procedure is conducted, either in an atmosphere of substantially reduced temperature or at room temperature, in order to allow the curing or solidification and the resulting formation of the second segment 26 of the lipstick product 20. The curing or solidification of the second segment 26 or second longitudinal half 28 seen in FIG. 13, while in contact with the previously formed first segment 25, will result in a permanent or integral bond between the first segment 25 and second segment 26. Upon removal of the mold parts 10 and 12 or 10 and 19 from one another a complete elongated substantially cylindrically configured lipstick product 20 will be formed.

It should be repeated that in a most preferred embodiment of the present invention both the segments 25 and 28 define substantially equally dimensioned longitudinal halves of the lipstick product 20. However, it is contemplated by the present invention that the aforementioned first and second molding parts, including possibly the cavities formed therein, may be of different sizes such that one of the segments 25 and 26, 28 may be larger than the other.

The separate formation of the first and second segments 25 and 26, 28 allows the color of the lipstick product 20 to be "customized" in its application. More specifically, it is contemplated that each of the segments 25 and 26 will be formed from different lipstick colors, such that one segment 25 may be of one preferred color and the second segment 26 may be of a second preferred color, with ideally, the first and second segments each defining a longitudinal half of the resulting lipstick product 20. The result will be each of the segments 25 and 26 defining generally a longitudinal half of the resulting lipstick product 20 but each being of a different, generally "customized" color so that when the resulting lipstick product is touched to the lips and glided thereacross, there will be a layer of one color applied first followed immediately and automatically by the application of a second layer of another color, which offers a uniquely customized look. If it were desired, one of both of the cavities 18, 30 formed in the mold parts could be structured to further include a divider therein, such as a longitudinally extending divider so as to offer a resulting lipstick product with more than two separately colored longitudinal halves, and that would still be within the scope and spirit of the present invention.

Since many modifications, variations and changes in detail can be made to the described preferred embodiment of the invention, such as by way of one example only, desiring to make an alternative customized lipstick product not directed only to color but to the providing of a higher wax content and/or protective lip balm either alone or in combination with color, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A multi-part mold assembly designed to form a lipstick product having a substantially elongated, cylindrical configuration, said mold assembly comprising:

a) a plurality of mold parts structured to include at least a first and a second cavity, each of said cavities designed and configured to form a different segment of the lipstick product being formed therein, b) a first and a second mold part of said plurality of mold parts each including a primary mating face, c) said first and second mold parts selectively positionable into and out of at least a first forming position defined by confronting engagement of said primary mating faces thereon, d) said first mold part including said first cavity formed therein in contiguous relation to said primary mating face thereof, e) said first cavity being structured and disposed to form a first segment portion of the lipstick product, f) said primary mating face of the second mold part including a substantially planar configuration disposable in covering relation to said first cavity in said first mold part when said first and second mold parts are in said first forming position, and g) said first and second mold parts being cooperatively structured to form the first segment of the lipstick product being less than the entire elongated, cylindrical configuration thereof when in said first forming position.

2. A mold assembly as in claim 1 wherein said second mold part further comprises a secondary mating face, and said second cavity formed in said second mold part in contiguous relation to said secondary mating face, said second cavity being structured and disposed to form a second segment of the lipstick product, said second cavity positionable in aligned relation to said first cavity to define a second forming position, said first and second mold cavities cooperatively dimensioned and configured to form a complete lipstick product defined by the first and second segments.

3. A mold assembly as in claim 2 wherein said first and second cavities are substantially equally dimensioned and configured to form an entire lipstick product when said first and second mold parts are in said second forming position.

4. A mold assembly as in claim 2 wherein said first and second cavities are substantially equally dimensioned and configured and cooperatively structured to form an entire lipstick product when said first and second mold parts are in said second forming position.

5. A mold assembly as in claim 2 further comprising an alignment structure mounted on both said first and second mold parts and structured to dispose said primary mating face of said first mold part in aligned, mating engagement with either said primary mating face or said secondary mating face of said second mold part dependent on said first and second mold parts being disposed in said first or second forming positions.

6. A mold assembly as in claim 2 wherein both said first and second cavities include a closed distal end and an open proximal end, said closed distal ends cooperatively structured to form a first end of the lipstick product, said open proximal ends disposed in communicating relation with an exterior of said first and second mold parts when in said second forming position.

7. A mold assembly as in claim 1 further comprising a connecting structure attachable to both said first and second mold parts and structured to removably maintain said first and second mold parts in said first forming position.

8. A mold assembly as in claim 1 further comprising a third mold part including a primary mating face and a second cavity formed therein in contiguous relation to said primary mating face thereof, said second cavity of said third mold part structured and disposed to form a second segment of the lipstick product and being positionable in aligned relation to said first cavity to define a second forming position, said first and second cavities of said first and third mold parts cooperatively dimensioned and configured to form a complete lipstick product defined by the first and second segments.

9. A mold assembly as in claim 8 wherein said first and second cavities are substantially equally dimensioned and configured to collectively form an entire lipstick product when said first and third mold parts are in said second forming position.

10. A mold assembly as in claim 8 further comprising an alignment structure mounted on both said first and third mold parts and disposed and structured to dispose said primary mating face of said first mold part in aligned, mating engagement with said primary face of said third mold part when said first and third mold parts are disposed in said second forming position.

11. A mold assembly as in claim 8 further comprising a connecting structure attachable to both said first and third mold parts and structured to removably maintain said first and third mold parts in said second forming position.

12. A kit assembly for forming a lipstick product from remnants of previously used lipstick products, said kit assembly comprising:

a) a mold assembly including a plurality of mold parts structured to include at least a first and a second cavity, b) said first and second cavities each designed and configured to form a different segment of the lipstick product being formed, c) said mold assembly further being structured to combine said first and second segments when said first and second segments are in different stages of curing, d) a removing tool structured and disposed to remove remnants of the lipstick from containers of previously used lipstick products, e) a heating utensil including an interior portion structured and disposed to collect the removed remnants and to contain the remnants during heating thereof, and f) said heating utensil further structured to facilitate transfer of the heated remnants to said mold assembly when the remnants are at least partially liquified.

13. A kit assembly as in claim 12 further comprising at least one container dimensioned and configured to receive the lipstick product being formed therein, said one container structured to selectively dispose at least a portion of the lipstick product in an exteriorly exposed position for use thereof.

14. A kit assembly as in claim 13 wherein said one container includes an attachment portion movably mounted thereon, said attachment portion structured and disposed to receive a base of the lipstick product for movable positioning of the lipstick product within said one container.

15. A kit assembly as in claim 12 wherein said plurality of mold parts include a first mold part and a second mold part each including a primary mating face, said first and second mold parts selectively positionable into and out of at least a first forming position defined by confronting engagement of said primary mating faces thereof, said first mold part including said first cavity formed therein in contiguous relation to said primary mating face thereof, said first mold cavity dimensioned and configured to form a first segment of the lipstick product, said primary face of said second mold part including a substantially planar configuration disposable in covering relation to said first cavity and said first mold part when said first and second mold parts are in said first forming position, said first and second mold parts being cooperatively structured to form the first segment of the lipstick product being less than the entire lipstick product being formed.

16. A kit assembly as in claim 15 wherein said second mold part further comprises a secondary mating face, and said second cavity is formed in said second mold part in contiguous relation to said secondary mating face and positionable in aligned relation to said first cavity to define a second forming position, said first and second cavities cooperatively dimensioned and configured to form said first and second segments respectively, wherein said first and second segments are cooperatively configured and dimensioned to form a complete lipstick product.

17. A kit assembly as in claim 15 wherein said plurality of mold parts further comprises a third mold part including a primary mating face and a second cavity formed therein in contiguous relation to said primary mating face thereof, said second cavity of said third mold part positionable in aligned relation to said first cavity to define a second forming position, said first and second cavities of said first and third mold parts cooperatively dimensioned and configured to form said first and said second segments wherein the first and second segments are cooperatively configured to form a complete lipstick product.

* * * * *